United States Patent [19]

Mause

[11] Patent Number: 4,944,133

[45] Date of Patent: Jul. 31, 1990

[54] APPARATUS FOR FORMING BAIT SACKS

[76] Inventor: James V. Mause, 621 Rogers, Fort Atkinson, Wis. 53538

[21] Appl. No.: 125,133

[22] Filed: Nov. 25, 1987

[51] Int. Cl.[5] ..... B65B 67/06

[52] U.S. Cl. ..... 53/390

[58] Field of Search ..... 53/219, 221, 222, 390, 53/464

[56] References Cited

U.S. PATENT DOCUMENTS

| | | | |
|---|---|---|---|
| 1,497,276 | 6/1924 | Hirschhorn | 53/464 X |
| 1,894,346 | 1/1933 | Cooper | 53/464 X |
| 2,783,599 | 3/1957 | Weikert | 53/442 |
| 3,175,338 | 3/1965 | Ahlgren et al. | 53/390 |
| 3,245,198 | 4/1966 | Schmied | 53/464 |
| 3,550,353 | 12/1970 | Haadsma | 53/390 |
| 3,696,585 | 10/1972 | Ritter | 53/390 |
| 4,555,893 | 12/1985 | Nakata et al. | 53/390 |

*Primary Examiner*—Robert L. Spruill
*Assistant Examiner*—Beth Bianca
*Attorney, Agent, or Firm*—Andrus, Sceales, Starke & Sawall

[57] ABSTRACT

An apparatus for preparing a bait sack includes a pair of plates that define a bait sack containing opening. The plate members are pivotally attached to a base member so that when preparing the bait sack, the plate members may be rotated to a position that facilitates access to the underside of the plate members so that the bait sack may be tied or sealed at a point substantially adjacent the bait.

4 Claims, 1 Drawing Sheet

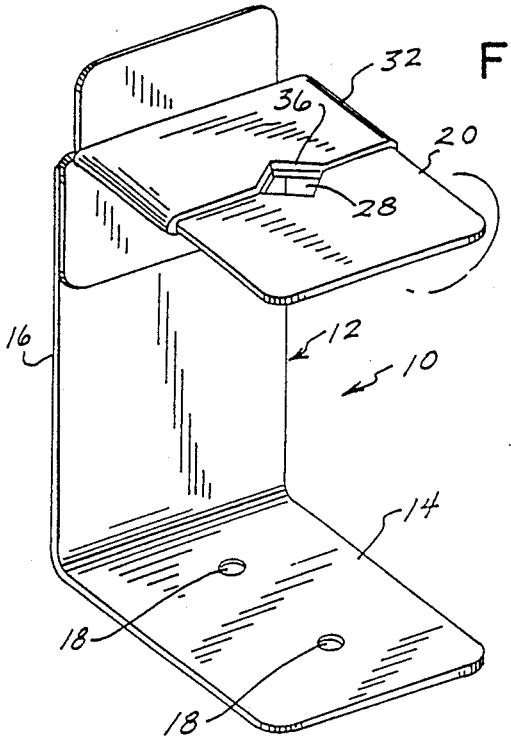
FIG. 1
FIG. 2
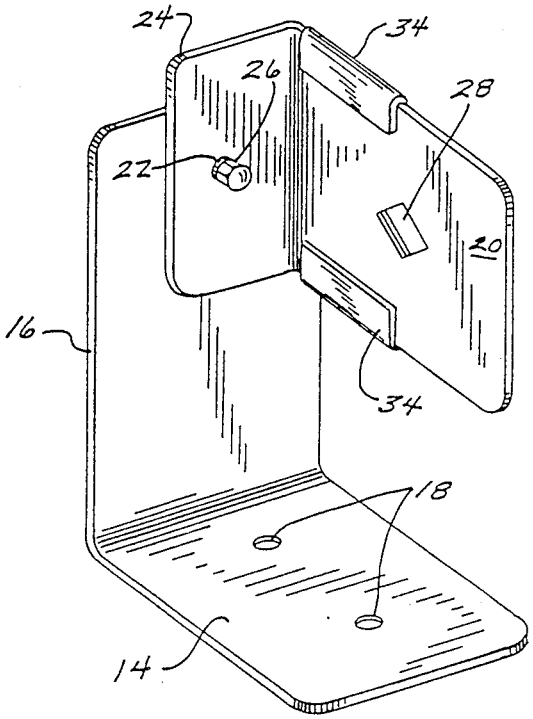
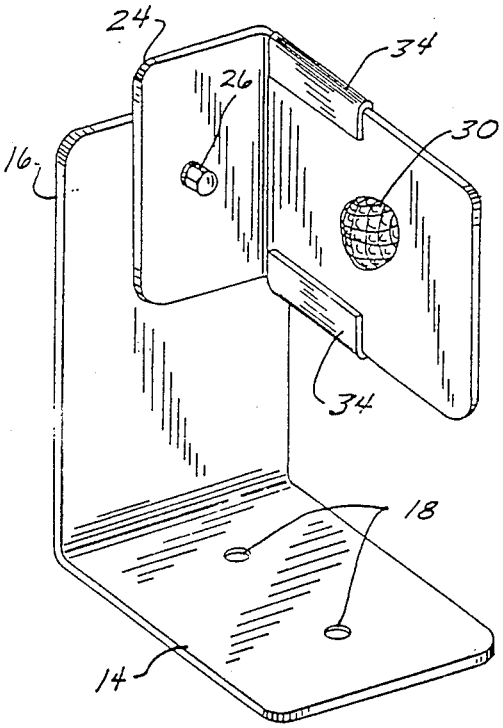
FIG. 3

APPARATUS FOR FORMING BAIT SACKS

BACKGROUND OF THE INVENTION

The present invention relates to an apparatus for preparing bait sacks to be used by fishermen and more particularly to an apparatus for tying or otherwise sealing bait such as salmon eggs in open mesh bags.

Some bait and particularly salmon eggs are not sufficiently coherent and self-supporting to be attached to a fishing line or hook. Therefore, such bait must be tied or sealed in an open mesh bag so that the bag may be attached to the hook or line.

When preparing such bait bags, it is desirable to tie or otherwise seal the bag as close as possible to the bait contained therein. Prior art patents such as U.S. Pat. No. 3,550,353 to Haadsma and U.S. Pat. No. 4,555,893 to Nakata et al provide devices for preparing bait sacks, however, the devices shown in these patents do not readily provide access to the bait sack at a point substantially adjacent the contained bait.

It is an object of this invention to provide an apparatus for clamping and tying or otherwise sealing bags of open mesh material about bait where the device allows for simple access to a point substantially adjacent the contained bait so that the bait sack may be tightly sealed with a minimum amount of excess sack material.

SUMMARY OF THE INVENTION

An apparatus for use in preparing bait sacks includes a pair of plate members slidably connected to each other and cooperating to define a closable opening in which a bait sack may be first filled and then closed.

In accordance with one aspect of the invention, one of the plate members is pivotally attached to a base member so that the plate member may be moved between a first position in which the plate member is disposed in a horizontal plane and a second position in which the plate member is disposed in a vertical plane so as to expose the bait sack and allow access to the bait sack at a point substantially adjacent the contained bait.

BRIEF DESCRIPTION OF THE DRAWINGS

The drawings illustrate the best mode presently contemplated of carrying out the invention.

In the drawings:

FIGURE 1 is a perspective view of the bait tying apparatus of the present invention shown with the plate members in an open and horizontal position;

FIG. 2 is a perspective view of the bait tying apparatus of FIG. 1 with the plate members shown rotated to a vertical position; and FIG. 3 is a perspective view of the bait tying apparatus of FIG. 1 shown with a bait sack contained and held by the plate members and with the plate members in a vertical position.

DESCRIPTION OF THE PREFERRED EMBODIMENT

The bait tying apparatus 10 includes a base member 12 consisting of a horizontal flange member 14 and an upwardly extending arm 16. Horizontal flange 14 is provided with a pair of holes 18 through which fasteners (not shown) may be passed in order to fasten apparatus 10 to a structure such as a boat seat or work bench.

A first plate member 20 is pivotally attached to arm 16 by means of a threaded fastener (not shown) that passes through a hole 22 in downwardly depending flange member 24. Rotation of nut 26 in a clockwise fashion tightens flange 24 against arm 16 and prevents relative movement between the two.

Conversely, counterclockwise rotation of nut 26 allows flange 24 to become disengaged from arm 16 and thus, allows for rotation of plate member 20 about this point.

First plate member 22 is provided with a diamond shaped opening 28 through which a bait sack 30 may be placed.

A second plate member 32 is slidably disposed over first plate member 20 by means of curved sidewalls 34 that define a channel through which plate member 20 slides.

Second plate 32 is provided with a centrally located notch 36 that corresponds in size and shape with half of opening 28. It can be seen that as plate 32 is moved outwardly towards the end of first plate 20 the sides of the diamond converge so that opening 28 is gradually closed as notch 36 approaches the opposite side of opening 28.

In operation, first and second plate members 20 and 32 are placed in the position shown in FIG. 1. A piece of mesh material is then placed over opening 28 and forced downwardly through the opening so as to form a bait receiving depression. Salmon eggs or some other bait material are then placed in the depression in the sack material and plate 32 is moved outwardly towards the edge of plate 20 so as to close opening 28 and to gather the mesh material above the plate members so as to form a bait sack 30. Since it is desirable to tie or otherwise seal the bait sack at a point as close as possible to the bait, plate 20 is then rotated to its position as shown in FIG. 3 so as to provide access to the bottom of now closed opening 28. Once in the position shown in FIG. 3, the bait sack may be tied or otherwise sealed at a point below that of plate members 20 and 32 which is a point substantially adjacent the enclosed bait. The rotating feature of plate member 20 greatly facilitates the tying or otherwise sealing of the bait sack at this point.

Various modes for carrying out the invention are contemplated as being within the scope of the following claims particularly pointing out and distinctly claiming the subject matter which is regarded as the invention.

What is claimed is:

1. An apparatus for use in preparing bait sacks comprising:

a base member adapted for securement to a structure and having an upwardly extending arm, a first plate member including means to pivotally attach said first plate member to an upwardly distal portion of said arm and movable between a first position in which said plate member is disposed in a substantially horizontal plane and a second position in which said plate member is disposed in a substantially vertical plane with said first member spaced from said base member in both of said first and second positions and a second member including means to slideably dispose said second member about said first plate member and movable between a first position in which the configuration of said member provides an opening and a second position in which said opening is substantially closed.

2. The apparatus defined in claim 1 wherein said second member comprises a plate and said means to slideably dispose said second member includes a pair of curved shoulders which cooperate with said plate to define a channel which is slideable over said first plate member.

3. The apparatus defined in claim 1 wherein said first plate is disposed below said second member.

4. The apparatus defined in claim 1 wherein said first plate includes a downwardly depending flange with said flange pivotally mounted to said arm.

* * * * *